US005843864A

United States Patent [19]

Popp et al.

[11] Patent Number: 5,843,864

[45] Date of Patent: Dec. 1, 1998

[54] NON-SMUDGING THERMALLY IMAGEABLE DOCUMENTS, METHOD OF MAKING SAME AND SYSTEM FOR REDUCING THE SMUDGING OF INK STAMP PAD IMAGES APPLIED TO SUCH DOCUMENTS

[75] Inventors: Mark R. Popp, Mount Juliet, Tenn.; Ora W. Jones, Hudson, Fla.

[73] Assignee: DocuSystems, Inc., Morton Grove, Ill.

[21] Appl. No.: 806,539

[22] Filed: Feb. 24, 1997

[51] Int. Cl.[6] ..... B41M 5/165

[52] U.S. Cl. ..... 503/201; 427/150; 427/152; 427/261; 427/288; 503/206; 503/226

[58] Field of Search ..... 427/150–152, 427/258, 261, 288; 503/200, 201, 206, 226

*Primary Examiner*—Bruce H. Hess

*Attorney, Agent, or Firm*—Laff, Whitesel, Conte & Saret, Ltd.

[57] ABSTRACT

A method of making a smudge-resistant thermally imageable document by applying a non-blocking ink stamp image receptive coating to the protective top coating, so that the image will dry within thirty second or less, and while producing an optical image density of at least 1.0. An ink comprising a dye, at least 8% m-pyrol by weight, a glycol, alcohol and water will dry quickly when applied from a stamp ink pad impregnated with that formulation.

21 Claims, 1 Drawing Sheet

NON-SMUDGING THERMALLY IMAGEABLE DOCUMENTS, METHOD OF MAKING SAME AND SYSTEM FOR REDUCING THE SMUDGING OF INK STAMP PAD IMAGES APPLIED TO SUCH DOCUMENTS

BACKGROUND OF THE INVENTION

Many documents, such as airline tickets or coupons, are stamped with ink from conventional stamp ink pads for a variety of purposes. For example, many airlines use such stamps by ticket agents at departure gates to indicate that a ticket has been "used." Such stamp ink images will transfer from a ticket to a ticket holder's hand, clothes or personal belongings if they do not quickly dry.

Many documents such as tickets today are produced from stock which is thermally imageable. Typical thermally imageable papers are provided with coatings which protect the thermal imaging layer against degradation both prior to imaging and subsequent to imaging, or which help control the imaging process. For example, thermally imageable products such as forms, tickets and tags are usually coated to protect against the effects of solvent-based marking media, sebum and other materials which tend to convert the imaging layer into a darkened image.

Documents which have been provided with such protective coatings most frequently display the failure of stamp ink pad images to dry, sometimes for as much as three or four hours or more. This results in wipe-off of portions of the images, sometimes thereby defeating the purpose of the image, as well as in the transfer of ink from the image to a user's body, clothing or property, to the dismay of a user.

It would therefore be desirable to eliminate the problem of unwanted stamp ink image transfer, while still providing the same coatings which are necessary and desirable to make thermally imageable paper documents which, when imaged, produce high quality images.

SUMMARY OF THE INVENTION

In accordance with the present invention, an improved thermally imageable document which is resistant to smudging and transfer of an stamp ink image applied to its surface and a method of making same is provided.

A method of making a thermally imageable document which resists smudging of stamp ink images in accordance with the present invention comprises the steps of providing a thermally imageable document having a base sheet, a thermal imaging layer and an overlying protective top coating resistant to the intrusion of moisture and solvents thereby protecting the thermal imaging layer from moisture and solvents, applying a non-blocking coating receptive to alcohols, glycols and water on a zone of the top coating to provide a Bekk smoothness of at least 50 seconds in the zone of the receptive coating, an optical image density of at least 1.00, when imaged, in the zone of the receptive coating, the receptive coating being absorptive of moisture and solvents such that an ink stamp image applied to the receptive coating from an ink stamp pad will dry to a smudge-resistant state within no more than about thirty seconds of its application to the receptive coating.

Preferably the receptive coating comprises polyvinyl pyrrolidone and wherein when an ink stamp image is applied from an ink stamp pad impregnated with a formulation which comprises a dye, at least eight percent m-pyrol by weight, a glycol, such as triethylene glycol, ethylene glycol and propylene glycol, and alcohol and water, the image will dry to a smudge-resistant state within no more than about thirty seconds of its application to the receptive coating.

In a most preferred form the base sheet of the thermally imageable document is a paper base sheet, the document is a ticket, the ink stamp image will dry within about 5 to 15 seconds, the Bekk smoothness is at least 65 seconds and the optical image density, when imaged, is at least 1.15.

A thermally imageable document in accordance with the present invention, comprises a base sheet, a thermal imaging layer thereon, and an overlying protective top coating resistant to the passage of moisture and solvents therethrough and for preventing the migration of moisture and solvents to the thermal imaging layer, the tope coating thereby protecting the thermal imaging layer from moisture and solvents, and a non-blocking coating on a selected zone of the protective top coating, the non-blocking coating being receptive to alcohols, glycols and water, the non-blocking receptive coating having a Bekk smoothness of at least 50 seconds and providing, when imaged, an optical image density of at least 1.00 in the zone of the receptive coating, the receptive coating being absorptive of moisture and solvents such that an ink stamp image applied to the receptive coating from an ink stamp pad will dry to a smudge-resistant state within no more than about thirty seconds of its application to the receptive coating. In a preferred form the receptive coating comprises polyvinyl pyrrolidone, the base sheet is a paper base sheet, the document is a ticket, the ink stamp image will dry within about 5 to 15 seconds, the Bekk smoothness is at least 65 seconds and the optical image density, when imaged, is at least 1.15.

In yet another aspect of the present invention, a stamp pad ink and an ink stamp pad impregnated with a stamp pad ink formulation are provided, the ink formulation comprising a dye in an amount of about three to about eight percent;

a glycol in an amount of about ten to about twenty-five percent;

m-pyrol in an amount of about six to about twelve percent;

alcohol in an amount of about six to about twelve percent;

water in an amount of about fifty to about seventy percent;

all by weight, the stamp pad ink preferably having an open time of at least one week at ambient conditions of 70° F. and a fifty percent relative humidity.

Further objects, features and advantages of the present invention will become apparent from the following description and drawings.

DETAILED DESCRIPTION

Figure 1:
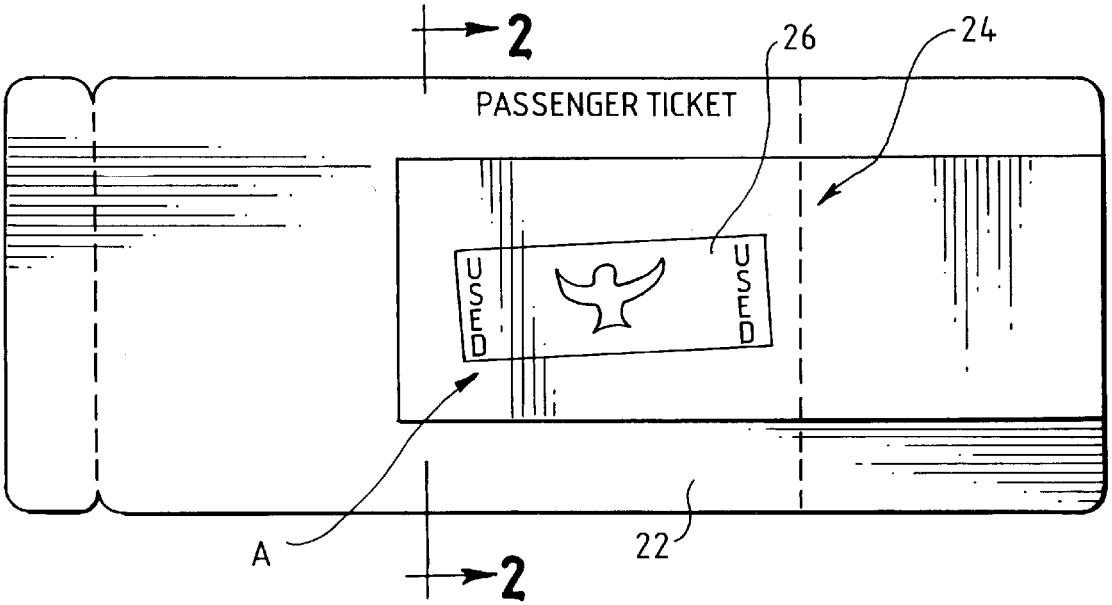
FIG. 1 is a plan view of a ticket embodying the present invention.

Referring now to the drawings, one form of a document in accordance with the present invention is shown in FIG. 1. As there shown, ticket 10 comprises a coated sheet of paperboard which is imprinted with printed indicia and which is adapted to be thermally imaged in any one of a variety of well-known thermal imagers.

Figure 2:
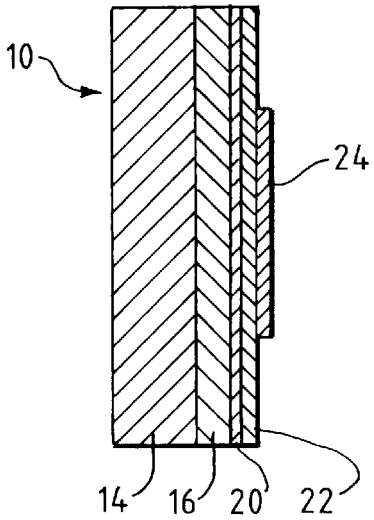
FIG. 2 is a schematic cross-sectional view of the ticket of FIG. 1, taken substantially along line 2—2 of FIG. 1.

As best illustrated by FIG. 2, the ticket 10 may comprise a base sheet such as a laminated base or base sheet which comprises a pair of layers 14 and 16 which are adhesively secured. The layer 16 is a thermally imageable sheet 16. A typical method of making such a laminated base sheet is described in U.S. Pat. No. 5,092,949. Thermally imageable sheet 16 may typically comprise a paper layer, a deposited thermal layer 20 and a protective barrier in the form of a top coat or overcoat 22. Protective overcoat 22 is typically resistant to the passage of moisture and solvents and greases or sebum and typically therefore comprises a material which is intended to be essentially impermeable to the inks, carriers and vehicles associated with stamp pad inks.

A variety of protective overcoatings for thermal papers are now in use. These include polyvinyl alcohol coatings and polyvinyl chloride coatings which repel solvents and water. Others include styrenated acrylics and styrenated maleic anhydride layers which also resist penetration by water and solvents. Protective overcoats 22 will tend to hold deposited inks, vehicles, carriers and such, on their surfaces, for an extended period, sometimes as much as up to four hours or more depending on the formulation of the ink, until it air dries. Of course, if the ink is formulated to dry rapidly, to avoid smearing or smudging in that fashion, it will also tend to dry rapidly in the stamp pad itself. This means that the pad, rather than serving for weeks or months, might be reduced to a service life of mere hours or days, something which would be highly undesirable in most instances.

Thus, to maintain the long-term efficacy of conventional stamp ink pads, unless other steps are taken, images transferred from conventional stamp ink pads for deposit on overcoated thermal paper documents tend to remain open and wet, and subject to smudging, for as many as several hours, during which time smudging and transfer to the clothes and bodies of customers and users may occur.

Typical commercially available stamp ink pads employ inks which use combinations of tri-ethylene glycol, glycerine and water as the vehicles for the dyes, such as the red and black dyes which are most commonly used. The use of glycol, glycerine and water provide stamp pad which have a very long shelf life. Inherently they then also have a long open time between the time of application of a stamp image to the time it dries to the touch. Thus, long open time resulting from the desire to have a long shelf life and long life for the use of the pad without re-inking necessarily is accompanied by a long open time which, in use on overcoated thermal documents, is undesirable.

Although a variety of top coated thermal papers may be used and will benefit from the practices of the present invention, in accordance with the present invention, the basic document stock used may desirably comprise a laminate of a uncoated facsimile paper, such as a relatively inexpensive conventional facsimile paper and a backing paper of a suitable weight. Desirably the average surface smoothness of the uncoated fax paper is between about 40 Bekk to about 350 Bekk. The laminate is thereafter coated with a protective top coat to provide the benefits of an overcoating, resistance to moisture, etc., and to enhance its imaging characteristics.

As used herein, the terms facsimile paper and fax paper mean a paper layer with a thermal chemistry coating on the paper layer to provide thermally activated imaging, characterized by (1) a basis weight of between 12 and 21 pounds per ream (base size—17"×22"); (2) little resistance to water, oils, fats, blood, alcohol and solvents; (3) poor archival quality for applications needing product and image stability longer than five years; and (4) a lack of capability to produce barcode imaging (or other machine readable indicia such as OCR) which is machine readable due to excessive bloom in imaging. Fax paper is to be understood as distinguishing from conventional topcoated thermal papers such as label, tag and ticket grade papers, all of which are considerably more expensive than facsimile paper.

One fax paper which may be used is an Appleton T-1022A paper available from Appleton Paper Company. It may be coated with a styrene-acrylic formulation to enhance its imaging characteristics, with formulation will serve also as a protective top coat. It is clear that a variety of facsimile papers will be usable and should produce improved documents in accordance with this invention as well. Other thermal papers such as chart papers which are commercially uncoated, work-in-process papers (substrates with heat-sensitive recording layers that are to receive topcoatings to render them useable for commercial purposes) and thermal papers which, because they are to be provided with a heat-metering layer, may omit one or more ingredients made unnecessary by the heat-metering layer, also may be used.

In one form of the invention, a coarse surfaced overcoat 22 which serves as a heat-metering layer is provided over the heat-sensitive, thermal recording layer 20. Overcoat 22, in this case, should preferably have an average surface smoothness of about 40 to 350 Bekk, preferably about 60–250 Bekk, and most preferably about 75–175 Bekk and should have a surface toughness such that substantially no coating material is removed therefrom when subjected to the Scrape-Resistance Test, as described hereinafter.

The overcoat 22 may be a material which takes on the characteristics of a thermosetting material rather than the melting and softening characteristics of a thermoplastic material, and which (1) can be coated onto the heat-sensitive recording layer of facsimile paper, (2) will conduct heat from the thermal printhead directly to the heat-sensitive recording layer in facsimile papers, (3) can be provided with a surface topography in the desired coarseness or Bekk reading range, and (4) has a surface toughness such that it resists removal of the coatings as determined by the Scrape-Resistance Test, all as described in U.S. Pat. No. 5,585,321, the disclosure of which is here incorporated by reference.

A variety of organic polymeric materials can be used to meet these requirements including polyacrylates, sulfonated polyacrylates, polystyrene/polybutadiene copolymers, polystyrene/polyacrylate copolymers, polyvinyl pyrrolidinones, polyvinyl acetate, polyvinyl chlorides, polyvinyl alcohol, styrenated maleic anhydride, and salts and halogenated forms of the above. Such polymeric materials preferably produce heat-metering layers having the characteristics of thermosetting resins. The organic polymeric material may be present in the heat-metering layer in amounts of from about 30 to about 50 weight percent of the active ingredients in the coating formulation.

As noted, when used as a heat-metering layer, overcoat 22 should maintain surface coarseness and integrity as the facsimile paper is subjected to heat and pressure during the thermal printing process.

The thickness of the overcoat 22 will usually range from 1 to 5 grams/square meter and preferably will range from about 1.5 to about 3 grams/square meter. Generally, slower or less sensitive heat-sensitive recording layers will require thinner overcoats 22, particularly where the thermal paper is to be used in cooler operating thermal imaging heads.

Thermal papers, including particularly facsimile paper coated with a heat-metering overcoat 22, may be laminated to backing paper to make a variety of documents, such as tags, labels, tickets and other printed articles with the desired bulk and stiffness. The backing paper may be of any desired thickness although thicknesses of 3 to 10 points are preferred and thicknesses of 4 points or more are most preferred. Suitable backing materials include Kraft paper, heavy paper, such as Westvaco 61# paper, etc.

The heat-metering overcoat 22 may be mechanically smoothened after the laminating step is completed or after the thermal paper has been made into pressure-sensitive label stock. This makes it possible to smoothen a completely assembled, finished laminated product, which greatly reduces surface imperfections which occur during laminating. It also permits smoothening at reduced pressures, compared to conventional practice in which smoothening of the topcoating is done before laminating is completed.

The Bekk smoothness referred to herein is determined using a Bekk surface meter (TAPPI #T479, OM-91). Such tests are reported as measurements of a specific amount of vacuum loss relative to a specific area (1.875 inches in diameter). Vacuum loss is determined in seconds until the vacuum reaches a predetermined point at which the reading is taken; thus "Bekk" is identified as the number of seconds to reach that point.

As used herein, the term Scrape-Resistance Test means a test conducted in the following manner using a Weller Universal Soldering Dual Heat Gun employing the available 0.5 centimeter straight dull blade ("the Heat Gun"). Samples of coated thermal paper are cut into strips 2" wide by 11" long in the machine direction. An area 0.5 cm by 0.5 cm of a sample is gently scraped with the Heat Gun blade in the low heat setting to remove all coating materials in that area, and so that the underlying base papers becomes exposed. Thus substantially all of the coating, both the applied coating and the thermal imaging material, is removed in that area. The sample is then carefully wiped down with a soft brush to remove any residue left on the paper from this operation and the caliper of the area scraped is measured. A backing paper is then taped to the sample so that the caliper in the scraped area of the sample measures 7.8 mils. The sample is then mounted on a test surface one inch in on the test surface.

The test surface is provided by a Chemsultants Adhesion/Release Tester with 12" test surface. The Heat Gun is mounted to a support, in this case being clampingly stabilized on a conventional ring stand, with the straight edge of the blade lying perpendicular to the direction of movement of the sample in the scraped area, being inclined at a 135 degree angle to the direction of movement of the sample being tested. A piece of backing paper is mounted to the back of the test surface so it will catch any residue resulting from the test. The Heat Gun is set to full power and turned on and allowed to warm at least one minute. The Release Tester is set to a speed of 60 feet per minute and turned on. The test surface then drags the sample underneath the Heat Gun blade. Once the full length of the sample is dragged under the blade, the Release Tester is turned off. Then the surface of the sample, the blade and the backing paper on the rear of the test surface are wiped with the soft brush to collect all residue from the test. The residue is then weighed in an analytical balance and recorded. Three samples are tested for each sample paper and the average weight is recorded.

Although a preferred embodiment employs a topcoated fax paper laminate of the type described, the practice of the invention may enhance the resistance to smudging of other coated thermal documents as well. Thus a wide range of thermal stock available for use in applications for a variety of thermally imageable documents including tickets and tags and which typically prevent the rapid drying of stamp ink images will benefit from the practice of the present invention. Typical documents will be prepared with paper bases, although other film bases may be employed as well.

In accordance with the present invention, a non-blocking receptive coating 24 receptive to alcohols, glycols and water is applied over the top coat or overcoat 22. Desirably the non-blocking receptive coating 24 has a Bekk smoothness which is at least as great as that of the overcoat 22. The overcoat 22 may be an overcoat as described above, or may be any of the typical overcoats used to protect thermal papers from the intrusion of moisture, solvents or grease. Receptive coating 24 may be applied over the entire surface of the ticket, as by flood coating, or may be zone coated in a selected zone or zones, such as in the zone A (FIG. 1), in which ink stamp images, such as ink stamp images 26, are to be provided. The receptive coating 24 is preferably applied after any conventional printed ink deposits are applied to the ticket or tag, but before the ticket is issued for use.

A preferred receptive coating 24 especially usable with an overcoat 22 of polyvinyl alcohol/polyvinyl latex or a styrenated maleic anhydride comprises a formulation of polyvinyl pyrrolidone. This may be applied by flood coating the entire surface of the thermally imageable ticket to be treated or, of course, a sheet or web of stock from which such tickets are to be formed. Alternatively it may be applied by zone coating a selected zone or zones of the ticket or of the stock from which the ticket is to be made. A suitable non-blocking composition, by weight, is as follows:

| | |
|---|---|
| Polyvinyl pyrrolidone | 20% |
| Water | 65% |
| Acrylic resin solution | 15% |

A preferred acrylic resin solution is Joncryl 61LV available from Johnson Wax. Joncryl 61LV is an aqueous varnish for use in water reducible coatings and comprises by weight about 35.0% by weight of resins solids, has a pH of 8.3–8.6, a viscosity of 2500±500 cps (Brookfield), a weight of 8.7±0.1 pounds/gallon, a density of 1.07 and a $T_g$ of 95° C. It typically includes 35.0% Joncryl 678 acrylic resin, 7.5% ammonia (28%), 1.5% ethylene glycol, 5% isopropyl alcohol, and the remainder water. It has high gloss and hold out characteristics. The acrylic resin solution is a film former and is a barrier to the passage of atmospheric moisture. It prevents blocking (the sticking of documents in a stack to each other). Despite that, when used in the receptive coating, the acrylic solution does not block the receptivity of the receptive coating 24 to water, glycols and alcohols. Although polyvinyl pyrrolidone is most preferably present in an amount of about 20 percent of the wet receptive coating, it may be used in an amount of up to about 30 percent, and preferably in an amount of at least 10 to 15 percent of the wet receptive coating, hence in an amount of from at least 10 to about 30 percent of the applied receptive coating, all by weight.

The receptive coating 24 may be deposited in an amount equal to about three (3) grams per square meter although ranges from two to six grams per square meter may be used as well. Polyvinyl pyrrolidone will accept water and glycol-based ink stamp pad images and will facilitate their drying against smudging within no more than about five (5) to about thirty (30) seconds, and preferably within no more than about five to ten seconds.

The receptive coating 24 adheres well to the underlying overcoat 22. It is also relatively smooth and thereby minimizes abrasion of the thermal head during thermal imaging. Because the receptive coating 24 will tend to affect the density of the thermal image (as will any overcoating, primarily because of the presence of additional coating material), it is desirable to use as thin a layer as possible and to limit the areas in which the receptive coating 24 is applied, preferably, where possible, to those areas in which thermal imaging is not intended to occur. In any event, receptive coatings 24 should be formulated and deposited with these criteria in mind.

In accordance with the present invention, a non-blocking receptive coating formulation comprising, by weight, polyvinyl pyrrolidone (twenty percent), Joncryl 61 (fifteen percent) and water (sixty-five percent) was applied to a standard thermally imageable document having an overcoated thermal layer as described above in the amount of from about 1 to about 3 grams per square meter. The resulting document, when imaged, had an optical image density of from about 1.15 to 1.20 as measured with an XRITE 418 densitometer available from XRITE Incorporated, 3100 44th Street NW, Grandville, Mich., 49418. The optical image densities referred to herein reflect readings taken with an XRITE 418. As used herein, the term optical image density means the contrast between the background density of the unimaged paper and the thermally imaged pattern as measured with an XRITE 418 or similar densitometer. This indicates how black the image is. The larger the number, the blacker the image. The two decimal places provide this number. The same document without the receptive coating, when imaged, had an optical image density of from about 1.15 to 1.20.

Although the receptive coating 24 may be applied as a separate coating over the overcoat 22, it may also be applied in combination with other coatings or dyes, in which case the receptive coating will then serve both as the receptive coating and to impart an additional function or functions. Thus, for example, if a coated ticket is to be overprinted with a layer which is intended to produce an additional characteristic, such as a zone having a desired color, the receptive coating material may be made part of the overprinted layer, thereby to minimize the number of passes which the ticket stock must make through a press prior to its completion. In such a case, the receptive coating-producing material, such as the polyvinyl pyrrolidone, should be made about 10 to about 30 percent of the overprinting layer.

Other receptive coating-producing materials may be used in some cases instead of polyvinyl pyrrolidone. These include urea, polyoxides such as poly(ethylene oxide), clay and silica dioxide. Their common characteristic is that they are receptive to alcohols, glycols and water and permit rapid drying of stamp ink pad images. If they are used, they should preferably be used in ranges of from about eight percent to about twenty percent of the receptive coating (by weight). Although clay and silica dioxide may be used for some purposes, they frequently tend to substantially degrade the optical image density of a thermal document to a level which is unacceptable for many documents, such as airline tickets. Silica dioxide also tends to be abrasive and therefore will unduly abrade optical imaging heads. Thus, silica dioxide and clay are not acceptable in many cases.

Typical formulations using other receptive coating producing materials employing, by weight, fifteen percent Joncryl 61, the indicated amount of other receptive coating ingredients and the remainder water, produced receptive coatings having the following optical image density reading ranges:

| | |
|---|---|
| 4% kaolin clay | 1.00–1.10 |
| 8% kaolin clay | 0.95–1.00 |
| 12% kaolin clay | 0.80–0.90 |
| 4% silica | 1.00–1.10 |
| 8% silica | 0.90–1.00 |
| 4% poly(ethylene oxide) | 1.10–1.15 |
| 5%–12% poly(ethylene oxide) | 1.00–1.10* |

From 12 to 20%, the polyoxide-containing formulations were too viscous and too water-sensitive to be usable. Suitable polyoxide formations are available from Union Carbide as its water soluble poly(ethylene oxide) resins identified as Polyox WSRN-80 grade having an approximate molecular weight measured rheologically of 200,000 and having a viscosity range of 65–115 mPa.sec(cP) in a 5% aqueous solution at 25° C. and Polyox WSRN-750 having an approximate molecular weight measured Theologically of 300,000 and having a viscosity range of 600–1000 mPa.sec (cP) in a 5% aqueous solution at 25° C. Other polyoxides may be employed.

Although the most common impressions applied to tickets which result in smudging due to the moisture resistant and solvent resistant characteristics of commonly applied top coats are those from ink stamp pads, images deposited from solvent-based markers and fountain pens and even from ball point pens tend to remain open for much longer than is desired. The receptive coatings applied and used in accordance with the present invention also tend to speed drying of such other images and therefore provide the advantages described with respect to ink stamp pad images herein.

The benefits of the application of the receptive coatings to the thermal documents, such as to tickets and the like as described herein, are most readily realized when the coatings are used with a modified, improved stamp pad ink formulation. The combination minimizes the drying time of the ink stamp images while providing a stamp pad which has an open time of at least a week.

In accordance with that aspect of the present invention, an ink formulation for impregnating an ink stamp pad comprises a dye, m-pyrol, a vehicle of water, alcohol and a glycol, and a gelling agent. Unlike conventional stamp pad inks, it includes essentially no tri-ethylene glycol or glycerine, which are major ingredients of conventional stamp pads inks. The purpose of tri-ethylene glycols and glycerine is to provide long shelf life (longevity), sometimes for a year or two. The stamp pad ink of the present invention tends to bite into the porous coating, thereby to speed the process of drying the deposited ink stamp.

A presently preferred stamp pad ink formulation comprises, by weight:

| | |
|---|---|
| Spectra Scarlett Moo Dye | 4% |
| Propylene glycol | 20% |
| Ethyl alcohol | 10% |
| Water | 30% |
| M-pyrol (2 vinyl n-pyrrolidone) | 10% |
| Ethyl hydroxy ethyl cellulose | 26% |
| (EHAC) (1% solution in water) | 100% |

Although they are not so limited in function, propylene glycol tends to stabilize the dye, ethyl alcohol tends to facilitate drying and penetration into the receptive coating, the EHAC contributes to gelation, and m-pyrol is a wetting agent and solvent.

Desirably the m-pyrol is present in an amount of from about 6 to 12%. Other glycols which may be used include triethylene glycol, diethylene glycol and ethylene glycol.

The system provided by the stamp pad ink formulation and the receptive coating is ideally suited to thermal documents such as tickets in which abrasion of the thermal print heads is an important concern, as is the retention of sharp optical images. In accordance with the system of this invention Bekk smoothness of the tickets can be maintained at a level of at least 50 seconds and more desirably at a level of at least 65 seconds, which maintaining an optical image density of at least 1.00 and preferably at least 1.15 to 1.20, while providing drying to a smudge-free state in at least about thirty seconds and preferably in about 5 to 15 seconds, and while maintaining an ink pad open time (useful life) of at least one week.

It will be apparent to those skilled in the art that modifications may be made in the specific embodiments described herein without departing from the spirit or scope of the invention. As such the invention is not intended to be limited except as may be specifically required by the appended claims.

What is claimed is:

1. A method of making a thermally imageable document which resists smudging of stamp ink images, comprising the steps of providing a thermally imageable document having a base sheet, a thermal imaging layer and an overlying protective top coating resistant to the intrusion of moisture and solvents thereby protecting the thermal imaging layer from moisture and solvents, and applying a non-blocking coating receptive to alcohols, glycols and water on a zone of said top coating to provide a Bekk smoothness of at least 50 seconds in the zone of the receptive coating, an optical image density of at least 1.00, when imaged, in the zone of the receptive coating, said receptive coating being absorptive of moisture and solvents such that an ink stamp image applied to said receptive coating from an ink stamp pad will dry to a smudge-resistant state within no more than about thirty seconds of its application to the receptive coating.

2. A method in accordance with claim 1, and wherein said receptive coating comprises polyvinyl pyrrolidone.

3. A method in accordance with claim 1, and wherein an ink stamp image is applied from an ink stamp pad impregnated with a formulation which comprises a dye, at least eight percent m-pyrol by weight, a glycol, and alcohol and water.

4. A method in accordance with claim 1, and wherein said receptive coating includes a dye.

5. A method in accordance with claim 1, and wherein said Bekk smoothness is at least 65 seconds, and wherein said optical image density is at least 1.15.

6. A method in accordance with claim 1, and wherein said ink stamp image will dry to a smudge-resistant state within about 5 to 15 seconds.

7. A method in accordance with claim 1, and wherein said base sheet of the thermally imageable document is a paper base sheet.

8. A method in accordance with claim 1, and wherein said base sheet is a paper base sheet, said document is a ticket, said ink stamp image will dry within about 5 to 15 seconds, said Bekk smoothness is at least 65 seconds and said optical image density, when imaged, is at least 1.15.

9. A method in accordance with claim 1 and wherein said receptive coating is disposed on only a portion of said top coating.

10. A thermally imageable document comprising a base sheet, a thermal imaging layer thereon, an overlying protective top coating resistant to the passage of moisture and solvents therethrough and for preventing the migration of moisture and solvents to the thermal imaging layer, thereby protecting the thermal imaging layer from moisture and solvents, and a non-blocking coating on a selected zone of said protective top coating, said non-blocking coating being receptive to alcohols, glycols and water, said non-blocking receptive coating having a Bekk smoothness of at least 50 seconds and providing, when imaged, an optical image density of at least 1.00 in the zone of the receptive coating, and said receptive coating being absorptive of moisture and solvents such that an ink stamp image applied to said receptive coating from an ink stamp pad will dry to a smudge-resistant state within no more than about thirty seconds of its application to the receptive coating.

11. The thermally imageable document in accordance with claim 10, and wherein said receptive coating comprises polyvinyl pyrrolidone.

12. The thermally imageable document in accordance with claim 10, and wherein an ink stamp image is applied from an ink stamp pad impregnated with a formulation which comprises a dye, at least eight percent m-pyrol by weight, a glycol, and alcohol and water.

13. The thermally imageable document in accordance with claim 10, and wherein said receptive coating includes a dye.

14. The thermally imageable document in accordance with claim 10, and wherein said Bekk smoothness is at least 65 seconds, and said optical image density is at least 1.15.

15. The thermally imageable document in accordance with claim 10, and wherein said ink stamp image will dry to a smudge-resistant state within about 5 to 15 seconds.

16. The thermally imageable document in accordance with claim 10, and wherein said base sheet is a paper base sheet.

17. The thermally imageable document in accordance with claim 10, and wherein said base sheet is a paper base sheet, said document is a ticket, said ink stamp image will dry within about 5 to 15 seconds, said Bekk smoothness is at least 65 seconds and said optical image density, when imaged, is at least 1.15.

18. The thermally imageable document of claim 10, and wherein said document comprises a ticket having a main ticket section and a stub section removable from said main ticket section along a line of serrations and wherein said selected zone bridges said line of serrations, and portions of said selected zone lie on each side of said line of serrations.

19. A process for reducing the smudging of ink stamp images when such images are applied to a thermally imageable document from an ink stamp pad, said process comprising providing a thermally imageable document comprising a base sheet, a thermal imaging layer thereon and an overlying protective top coating resistant to the passage of moisture and solvents therethrough and for preventing the migration of moisture and solvents to the thermal imaging layer, thereby to protect the thermal imaging layer from moisture and solvents, said document having a non-blocking coating receptive of alcohols, glycols and water which covers a selected zone of said protective top coating, said non-blocking receptive coating having a Bekk smoothness at least as great as that of the overlying protective coating, and an optical image density, upon imaging, of at least 1.10 as measured by an XRITE 418 densitometer, and applying to said selected zone an ink stamp image from an ink stamp pad impregnated with an ink comprising a dye, at least eight percent m-pyrol by weight, a glycol, and alcohol and water, whereby said ink stamp image will dry to a smudge-resistant state within no more than about sixty seconds of its application to the receptive coating.

20. A process in accordance with claim 19, and wherein said ink in said ink stamp pad has an open time of at least one week.

21. A process in accordance with claim 20, and wherein said ink stamp image will dry to a smudge-resistant state within no more than about thirty seconds of its application to the receptive coating.

* * * * *

UNITED STATES PATENT AND TRADEMARK OFFICE

CERTIFICATE OF CORRECTION

PATENT NO. : 5,843,864

DATED : December 1, 1998

INVENTOR(S) : Mark R. Popp and Ora W. Jones

It is certified that error appears in the above-indentified patent and that said Letters Patent is hereby corrected as shown below:

Column 8, line 10, insert --an asterisk (*)-- before the word "From".

Column 8, line 59, move "(EHAC) (1% solution in water)" up so that it reads:

Ethyl Hydroxy ethyl cellulose
(EHAC) (1% solution in water)

Signed and Sealed this

Eleventh Day of May, 1999

*Attest:*

Q. TODD DICKINSON

*Attesting Officer*

*Acting Commissioner of Patents and Trademarks*